US011004402B2

(12) United States Patent
Ji et al.

(10) Patent No.: US 11,004,402 B2
(45) Date of Patent: May 11, 2021

(54) INTEGRATED CIRCUIT FOR OPERATING DISPLAY PANEL

(71) Applicant: SILICON WORKS CO., LTD., Daejeon (KR)

(72) Inventors: Seung Hwan Ji, Daejeon (KR); Min Young Jeong, Daejeon (KR); Yong Jung Kwon, Daejeon (KR); Jung Bae Yun, Daejeon (KR); Jeung Hie Choi, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 16/651,791

(22) PCT Filed: Nov. 29, 2018

(86) PCT No.: PCT/KR2018/014911
§ 371 (c)(1),
(2) Date: Mar. 27, 2020

(87) PCT Pub. No.: WO2019/107952
PCT Pub. Date: Jun. 6, 2019

(65) Prior Publication Data

US 2020/0312249 A1 Oct. 1, 2020

(30) Foreign Application Priority Data

Nov. 30, 2017 (KR) ..... 10-2017-0163792

(51) Int. Cl.
*G09G 3/3291* (2016.01)
*G09G 3/3258* (2016.01)

(52) U.S. Cl.
CPC ..... *G09G 3/3291* (2013.01); *G09G 3/3258* (2013.01); *G09G 2310/08* (2013.01)

(58) Field of Classification Search
None
See application file for complete search history.

(56) References Cited

U.S. PATENT DOCUMENTS

| | | | | |
|---|---|---|---|---|
| 10,013,906 | B2 | 7/2018 | Lee et al. | |
| 10,089,918 | B2 | 10/2018 | Kwon et al. | |
| 10,096,281 | B2 | 10/2018 | An | |
| 2016/0063910 | A1* | 3/2016 | An | G09G 3/3233 345/691 |
| 2017/0053598 | A1 | 2/2017 | Kwon et al. | |
| 2017/0193877 | A1 | 7/2017 | Lee et al. | |

FOREIGN PATENT DOCUMENTS

| | | | |
|---|---|---|---|
| KR | 10-2015-0078356 | A | 7/2015 |
| KR | 10-2016-0017358 | | 2/2016 |
| KR | 10-2016-0028584 | A | 3/2016 |
| KR | 10-2017-0022318 | A | 3/2017 |
| KR | 10-2017-0080226 | A | 7/2017 |

OTHER PUBLICATIONS

PCT International Search Report, PCT/KR2018/014911, dated Feb. 21, 2019, 4 Pages.

* cited by examiner

*Primary Examiner* — Christopher J Kohlman
(74) *Attorney, Agent, or Firm* — Fenwick & West LLP

(57) ABSTRACT

An embodiment provides a technology relating to data transmission or reception in a display panel. In the embodiment, a plurality of integrated circuits sharing a data line may transmit an indication signal through signal lines connected 1:1 to the circuits, and transmit data through the data line in response to the indication signal.

16 Claims, 9 Drawing Sheets

INTEGRATED CIRCUIT FOR OPERATING DISPLAY PANEL

TECHNICAL FIELD

The present disclosure relates to an integrated circuit for operating a display panel.

BACKGROUND ART

A display panel comprises a data processing device for receiving image data from a host and primarily processing it. The data processing device, also referred to as a timing controller, converts the image data in accordance with a characteristic of a panel and transmits the converted image data to a data driving device.

The data driving device, also referred to as a source driver, column driver, or the like, converts the received image data into a data voltage and drives a pixel disposed on the panel using the data voltage.

Among various types of display panels, a panel using organic light emitting diodes (OLED) comprises steps of sensing a change of a characteristic of a pixel and complementing image data in accordance with the changed characteristic of the pixel. Here, a sensing device transmits sensing data about the pixel characteristic to the data processing device.

A sensing device is often disposed in the same package as that of a data driving device. In such a product, it may be considered that the data driving device practically transmits sensing data to a data processing device.

As described above, in a display panel, various types of data, such as image data, sensing data, or the like, are transmitted and received between multiple devices.

A sensing device or a data driving device for transmitting sensing data may comprise a plurality of integrated circuits, instead of one integrated circuit. Recently, there is a tendency that, as a display panel has a higher resolution and a larger area, the number of pixels disposed on a display panel increases. In accordance with such a tendency, the number of integrated circuits forming a sensing device or a data driving device also increases.

A panel is divided into a plurality of sections, each pixel in each section of the panel is sensed by an integrated circuit in charge of each section, and sensing data generated by a plurality of integrated circuits is gathered in a data processing device and processed as sensing data for the entire panel. Here, in a case when two or more integrated circuits share a data line, a method of allowing a plurality of integrated circuits to transmit sensing data without collision would be an issue.

Conventionally, a cascade carry method in which a plurality of integrated circuits are connected with a data processing device through carry lines, an integrated circuit transmits sensing data and subsequently transmits a carry signal to another integrated circuit, and then, the integrated circuit, that receives the carry signal, transmits sensing data and subsequently transmits a carry signal to another integrated circuit is used. In this method, there is a problem that, in a case when sensing data needs to be received again from a certain integrated circuit, the entire integrated circuits must transmit again sensing data.

DETAILED DESCRIPTION OF THE INVENTION

Technical Problem

In this background, according to an aspect, the present disclosure is to provide a technique for allowing a plurality of integrated circuits sharing a data line to efficiently transmit data.

Technical Solution

To this end, an aspect of the present disclosure provides an integrated circuit for sensing one section of a panel, which is divided into a plurality of sections, comprising: a sensing circuit to sense a characteristic of a pixel disposed in the one section and to generate sensing data; a signal controlling circuit to transmit an indication signal to a device for gathering the sensing data through a signal line connected in a one to one (1:1) way; and a transmitting circuit to transmit, in accordance with the transmission of the indication signal, the sensing data to the device through a data line connected in a one to N (1:N) way (N is a natural number, which is 2 or higher).

The indication signal may be a signal indicating that the data line is occupied by the integrated circuit or instructing the integrated circuit to occupy the data line.

The integrated circuit may further comprise a receiving circuit to receive, from the device, image data complemented according to the sensing data and a driving circuit to convert the image data into a data voltage and to transmit the data voltage through a data voltage line connected with the pixel.

Another aspect of the present disclosure provides a data processing integrated circuit comprising a receiving circuit to receive sensing data of pixels disposed on a panel from a plurality of data driving integrated circuits through a sensing data line connected in a 1:N way (N is a natural number, which is 2 or higher); a signal controlling circuit to receive indication signals through a plurality of signal lines connected in a 1:1 way with the plurality of the data driving integrated circuits and to transmit sensing data in accordance with the indication signals; a complementing circuit to complement image data in accordance with the sensing data; and a transmitting circuit to transmit the complemented image data to each of the plurality of the data driving integrated circuits through each of image data lines.

Each of the data driving integrated circuits checks the state of the data line and when the data line is not recognized to be in a specific state in which the sensing data cannot be transmitted, each of the data driving integrated circuits may transmit the sensing data at a certain time point.

Effects of the Invention

As described above, according to the present disclosure, it is possible that a plurality of integrated circuits sharing a data line efficiently transmit data. For example, each integrated circuit may regularly or irregularly transmit data and easily re-transmit data for complementing data, or only some integrated circuits may repeatedly transmit or re-transmit data. This increases the efficiency of data transmission and reception.

MODE FOR IMPLEMENTING THE INVENTION

Figure 1:
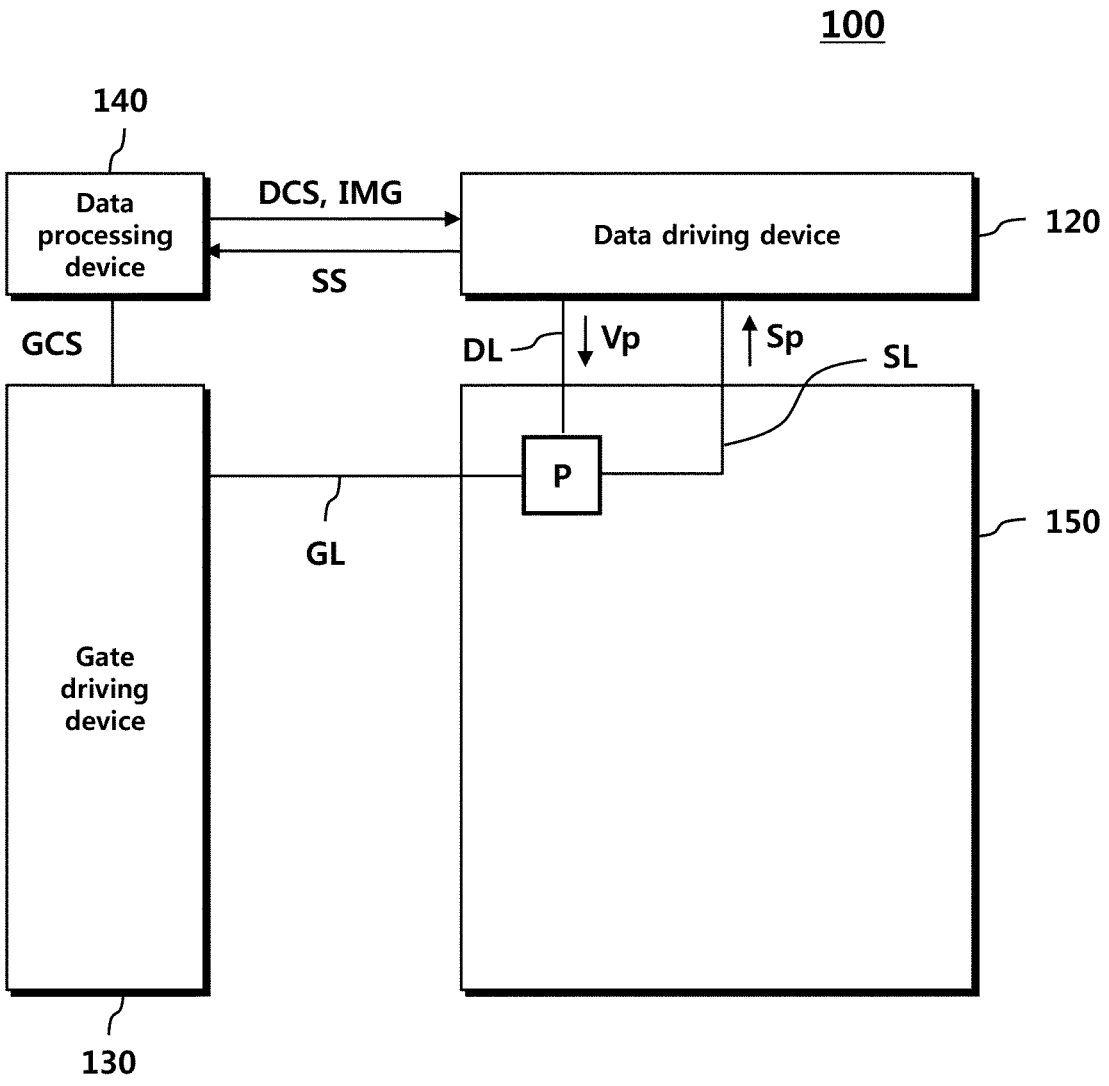
FIG. 1 is a configuration diagram of a display device according to an embodiment.

Hereinafter, some embodiments of the present disclosure will be described in detail with reference to the accompanying drawings. With regard to the reference numerals of the components of the respective drawings, it should be noted that the same reference numerals are assigned to the same components even though they are shown in different drawings. In addition, in describing the present disclosure, a detailed description of a well-known configuration or function related the present disclosure, which may obscure the subject matter of the present disclosure, will be omitted.

In addition, terms, such as "1st", "2nd", "A", "B", "(a)", "(b)", or the like, may be used in describing the components of the present disclosure. These terms are intended only for distinguishing a corresponding component from other components, and the nature, order, or sequence of the corresponding component is not limited to the terms. In the case where a component is described as being "coupled", "combined", or "connected" to another component, it should be understood that the corresponding component may be directly coupled or connected to another component or that the corresponding component may also be "coupled", "combined", or "connected" to the component via another component provided therebetween.

FIG. 1 is a configuration diagram of a display device according to an embodiment.

Referring to FIG. 1, a display device 100 may comprise a plurality of display panel driving devices 120, 130, 140 and a display panel 150.

On the display panel 150, a plurality of data voltage lines DL, a plurality of gate lines GL, and a plurality of pixels P may be disposed.

The display panel driving devices 120, 130, 140 are to generate signals for displaying images on the display panel 150. A data driving device 120, a gate driving device 130, and a data processing device 140 may correspond to the display panel driving devices 120, 130, 140.

The gate driving device 130, also referred to as a gate driver, may supply gate driving signals, such as turn-on voltages or turn-off voltages, through the gate lines GL. When a gate driving signal of a turn-on voltage is supplied to a pixel P, the pixel P is connected with a data voltage line DL. When a gate driving signal of a turn-off voltage is supplied to a pixel P, the pixel P is disconnected from the data voltage line DL.

The data driving device 120, also referred to as a source driver, may supply a data voltage Vp to a pixel P through a data voltage line DL. The data voltage Vp may be supplied to the pixel P through the data voltage line DL according to the gate driving signal.

The data processing device 140, also referred to as a timing controller, may supply control signals to the gate driving device 130 and the data driving device 120. For example, the data processing device 140 may transmit a gate control signal GCS making a scan to start and output image data IMG to the data driving device 120. In addition, the data processing device 140 may transmit a data control signal DSC for controlling the data driving device 120 in order to supply a data voltage Vp to each pixel P.

The display device 100 may further comprise a sensing device. The sensing device may sense pixels P disposed on a panel and transmit sensing data SS to the data processing device 140.

In terms of hardware, the sensing device and the data driving device 120 may be disposed in one semiconductor package. For the convenience of explanation, hereinafter, the data driving device 120 will be described as a subject that senses pixels P and transmits sensing data SS. However, it should be noted that a sensing device may be implemented in a semiconductor package different from that for a data driving device 120 depending on embodiments.

The data driving device 120 may receive a sensing signal Sp from a pixel P through a sensing line SL. In addition, the data driving device 120 may convert the sensing signal Sp into sensing data SS and transmit the sensing data SS to the data processing device 140.

A pixel P disposed on the panel 150 may have a characteristic that varies depending on the lapse of time or the change of its surrounding environment. Since the change of the characteristic of a pixel P also relates to the brightness of the pixel P, the data driving device 120 necessarily supplies a data voltage Vp according to a changed characteristic of the pixel P in order to maintain a uniform brightness of the pixel P.

The data processing device 140 determines a characteristic of a pixel P using sensing data received from the data driving device 120, complements image data IMG according to the characteristic of the pixel P, and then, transmits the complemented image data IMG to the data driving device 120. The data driving device 120 generates a data voltage Vp according to the complemented image data IMG. As such, the data driving device 120 can reflect the characteristic of the pixel P.

Each device may comprise one or more integrated circuits. When a display panel has higher resolution and a larger area, it becomes difficult for one integrated circuit to serve the entire area of a panel. To respond to such circumstances, a data processing device 140 and a data driving device 120 may comprise at least one integrated circuit. In particular, the data driving device 120 may comprise two or more integrated circuits. Hereinafter, an embodiment in which the data driving device 120 comprises two or more integrated circuits will be described.

Figure 2:
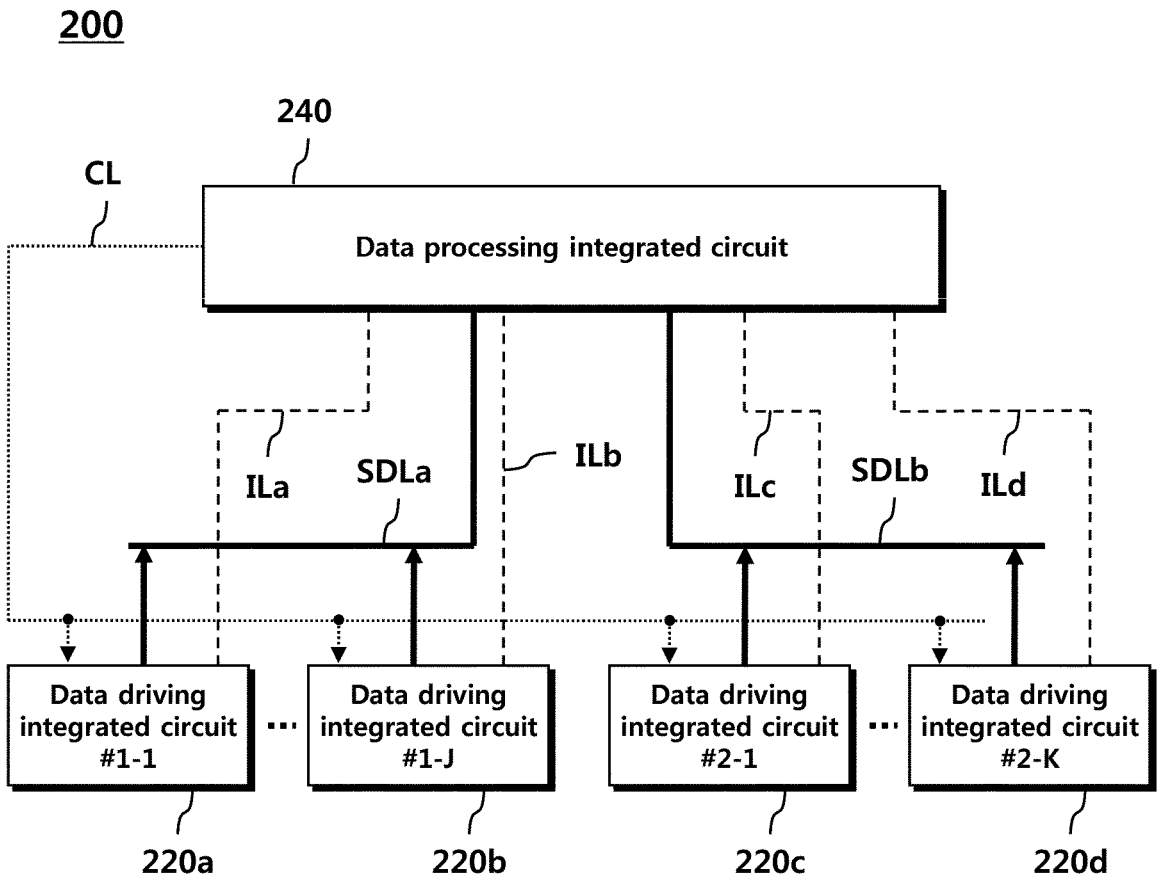
FIG. 2 is a configuration diagram of a panel driving device according to an embodiment.

FIG. 2 is a configuration diagram of a panel driving device according to an embodiment.

Referring to FIG. 2, a panel driving device 200 may comprise one data processing integrated circuit 240 and a plurality of data driving integrated circuits 220*a*, . . . , 220*b*, 220*c*, . . . , 220*d*.

The plurality of data driving integrated circuits 220*a*, . . . , 220*b*, 220*c*, . . . , 220*d* may sense one section of the panel, which is divided into a plurality of sections. The data processing integrated circuit 240 may gather sensing data from the plurality of data driving integrated circuits 220*a*, . . . , 220*b*, 220*c*, . . . , 220*d* to determine characteristics of pixels disposed on the panel.

The plurality of data driving integrated circuits 220*a*, . . . , 220*b*, 220*c*, . . . , 220*d* may be connected with the data processing integrated circuit 240 through sensing data lines SDLa, SDLb. The plurality of data driving integrated circuits 220*a*, . . . , 220*b*, 220*c*, . . . , 220*d* may transmit sensing data to the data processing integrated circuit 240 through the sensing data lines SDLa, SDLb.

The plurality driving integrated circuits 220*a*, . . . , 220*b*, 220*c*, . . . , 220*d* may share the sensing data lines SDLa, SDLb. In one panel, two or more sensing data lines SDLa, SDLb may be disposed, the plurality of data driving integrated circuits 220*a*, . . . , 220*b*, 220*c*, . . . , 220*d* may be grouped in a plurality of groups, and each of the sensing data lines SDLa, SDLb may be shared in each group. For example, a plurality of data driving integrated circuits 220*a*, . . . , 220*b* belonging to a first group may share a first sensing data line SDLa and a plurality of data driving integrated circuits 220*c*, . . . , 220*d* belonging to a second group may share a second sensing data line SDLb. The data processing integrated circuit 240 may separately receive sensing data through each of the sensing data lines SDLa, SDLb.

The plurality of data driving integrated circuits 220*a*, . . . , 220*b*, 220*c*, . . . , 220*d* may transmit sensing data to the data processing integrated circuit 240 through the sensing data lines SDLa, SDLb respectively connected in a 1:N way (N is a natural number, which is two or higher). Here, in order to prevent data to be transmitted from colliding, each of the plurality of data driving integrated circuits 220*a*, . . . , 220*b*, 220*c*, . . . , 220*d* may transmit sensing data using time division.

On the other hand, the plurality of data driving integrated circuits 220*a*, . . . , 220*b*, 220*c*, . . . , 220*d* may transmit indication signals to the data processing integrated circuit 240 through signal lines ILa, . . . , ILb, ILc, . . . , ILd respectively connected in a 1:1 way.

An indication signal is used to instruct one of the data driving integrated circuits 220*a*, 220*b*, 220*c*, . . . , 220*d* to occupy one the sensing data lines SDLa, SDLb. The data processing integrated circuit 240 may identify one of the data driving integrated circuits 220*a*, . . . , 220*b*, 220*c*, . . . , 220*d* to transmit sensing data using the indication signal.

The data processing integrated circuit 240 may assign each of the data driving integrated circuits 220*a*, . . . , 220*b*, 220*c*, . . . , 220*d* to each of the signal lines ILa, . . . , ILb, ILc, . . . , ILd. When the data processing integrated circuit 240 identifies one of the signal lines ILa, . . . , ILb, ILc, . . . , ILd through which an indication signal is received, the data processing integrated circuit 240 may recognize that the one of the data driving integrated circuits 220*a*, . . . , 220*b*, 220*c*, . . . , 220*d*, assigned to the signal line ILa, . . . , ILb, ILc, . . . , ILd through which the indication signal is received, transmits sensing data.

Each of the signal lines ILa, . . . , ILb, ILc, . . . , ILd may be a single line. Each of the data driving integrated circuits 220*a*, . . . , 220*b*, 220*c*, . . . , 220*d* may transmit an indication signal by changing a voltage level formed in a signal line ILa, . . . , ILb, ILc, . . . , ILd. In some embodiments, the data processing integrated circuit 240 may transmit an indication signal by changing a voltage level formed in a signal line ILa, . . . , ILb, ILc, . . . , ILd. In some other embodiments, both the data driving integrated circuits 220*a*, . . . , 220*b*, 220*c*, . . . , 220*d* and the data processing integrated circuit 240 may transmit indication signals.

Between the plurality of data driving integrated circuits 220*a*, . . . , 220*b*, 220*c*, . . . , 220*d* and the data processing integrated circuit 240, a clock line CL may further be disposed. The data processing integrated circuit 240 may transmit a first clock through the clock line CL. Each of the data driving integrated circuits 220*a*, . . . , 220*b*, 220*c*, . . . , 220*d* may transmit sensing data synchronized with the first clock. The plurality of data driving integrated circuits 220*a*, . . . , 220*b*, 220*c*, . . . , 220*d* may share one clock line CL. The data processing integrated circuit 240 may transmit the first clock to the plurality of data driving integrated circuits 220*a*, . . . , 220*b*, 220*c*, . . . , 220*d* through the clock line CL shared by the plurality of data driving integrated circuits 220*a*, . . . , 220*b*, 220*c*, . . . , 220*d*.

Figure 3:
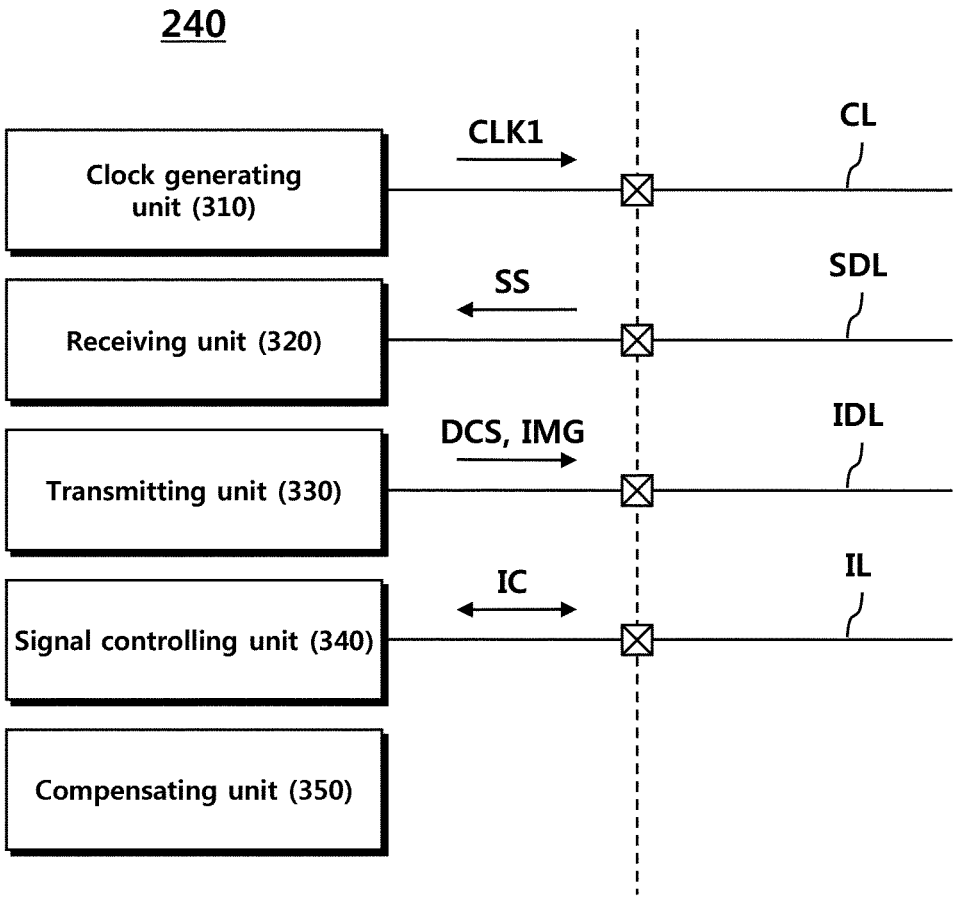
FIG. 3 is a configuration diagram of a data processing integrated circuit according to an embodiment.
Figure 4:
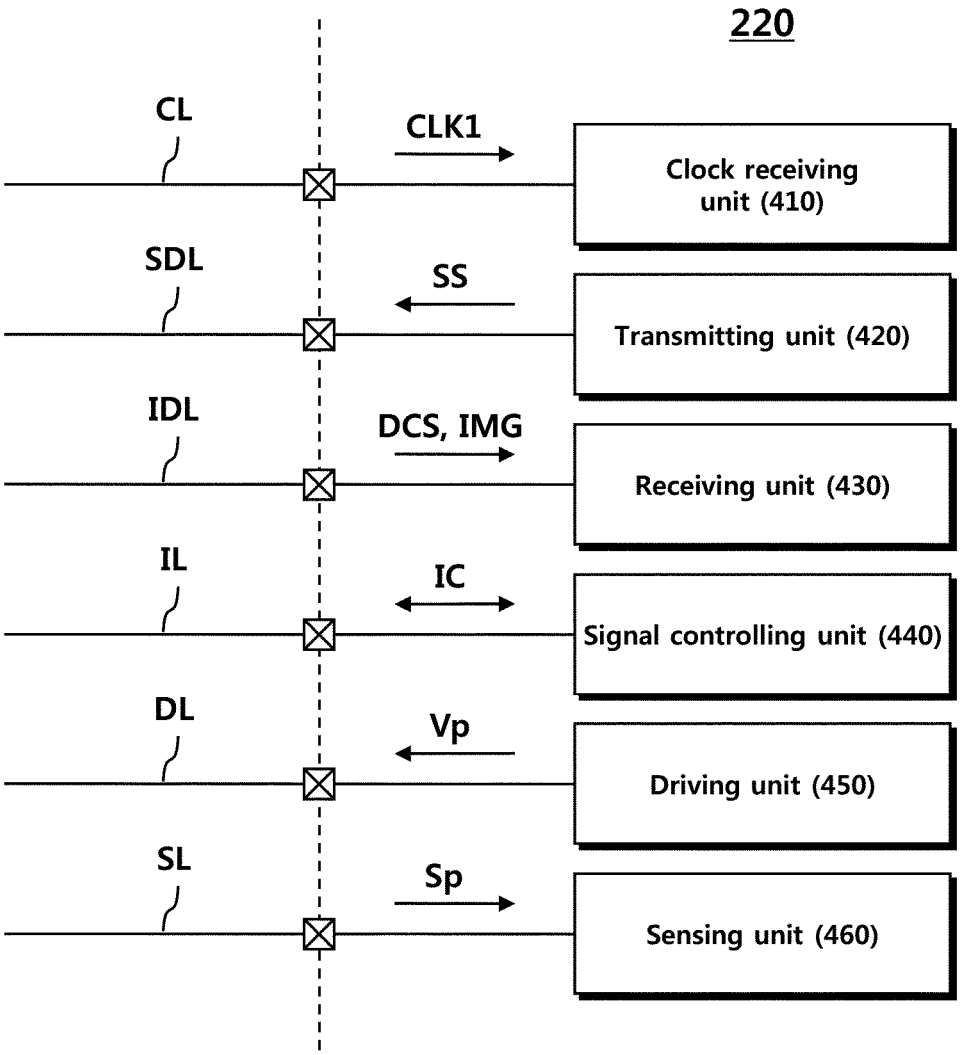
FIG. 4 is a configuration diagram of a data driving integrated circuit according to an embodiment.

FIG. 3 is a configuration diagram of a data processing integrated circuit according to an embodiment and FIG. 4 is a configuration diagram of a data driving integrated circuit according to an embodiment.

Referring to FIG. 3 and FIG. 4, the data processing integrated circuit 240 may comprise a clock generating circuit 310, a receiving circuit 320, a transmitting circuit 330, a signal controlling circuit 340, and a complementing circuit 350 and a data driving integrated circuit 220 may comprise a clock receiving circuit 410, a transmitting circuit 420, a receiving circuit 430, a signal controlling circuit 440, a driving circuit 450, and a sensing circuit 460.

The clock generating circuit 310 and the clock receiving circuit 410 may be connected with each other through the clock line CL. The clock generating circuit 310 may transmit a first clock CLK1 through the clock line CL and the clock receiving circuit 410 may receive the first clock CLK1 through the clock line CL.

The receiving circuit 320 of the data processing integrated circuit 240 may receive sensing data SS through a sensing data line SDL. The transmitting circuit 420 of the data driving integrated circuit 220 may transmit the sensing data SS through the sensing data line SDL. The transmitting circuit 420 of the data driving integrated circuit 220 may synchronize sensing data SS with the first clock CLK1 when transmitting the sensing data SS and the receiving circuit 320 of the data processing integrated circuit 240 may synchronize the sensing data SS with the first clock CLK1 when receiving the sensing data.

Sensing data SS may be generated by the sensing circuit 460 of the data driving integrated circuit 220. The sensing circuit 460 may receive a sensing signal Sp through the sensing line SL connected with a pixel and generate sensing data SS through an analog-digital conversion of the sensing signal Sp.

The transmitting circuit 330 of the data processing integrated circuit 240 may transmit image data IMG through an image data line IDL. The receiving circuit 430 of the data driving integrated circuit 220 may receive the image data IMG through the image data line IDL.

Image data IMG may be complemented data by reflecting a characteristic of a pixel. The complementing circuit 350 of the data processing integrated circuit 240 may determine a characteristic of a pixel using the received sensing data SS and complement the image data IMG by reflecting the characteristic of the pixel. The transmitting circuit 330 of the data processing integrated circuit 240 may transmit the complemented image data IMG to the data driving integrated circuit 220.

A control signal DCS may be transmitted, for example, in a form of digital data through an image data line IDL, from the transmitting circuit 330 of the data processing integrated circuit 240 to the receiving circuit 430 of the data driving integrated circuit 220. For another example, a control signal DCS may be transmitted in a form of an analog signal through another line, from the transmitting circuit 330 of the data processing integrated circuit 240 to the receiving circuit 430 of the data driving integrated circuit 220.

A control signal DCS may include a frame signal indicating a starting time point of a frame. The data driving integrated circuit 220 may determine a time point of an internal control using frame signals. For example, the driving circuit 450 of the data driving integrated circuit 220 may convert image data IMG into a data voltage Vp and transmit the data voltage Vp through a data voltage line DL every horizontal period determined by a frame signal.

The signal controlling circuit 340 of the data processing integrated circuit 240 or the signal controlling circuit 440 of the data driving integrated circuit 220 may transmit an indication signal IC through the signal line IL. In addition, the signal controlling circuit 340 of the data processing integrated circuit 240 may identify one of the data driving integrated circuits 220 transmitting sensing data SS by determining a signal line IL through which an indication signal IC is received.

In such a way, the transmitting circuit 420 of the data driving integrated circuit 220 may transmit sensing data SS at a time point determined by the data driving integrated circuit 220. For example, if sensing data SS needs to be transmitted by the data driving integrated circuit 220 at a certain time point, an indication signal IC may first be transmitted by the signal controlling circuit 440 through the signal line IL, and sensing data SS may subsequently be transmitted by the transmitting circuit 420.

The transmitting circuit 420 of the data driving integrated circuit 220 may regularly transmit sensing data SS every predetermined period, for example, every frame period. Specifically, a plurality of data driving integrated circuits 220 may determine a time point to transmit an indication signal IC by receiving a frame signal indicating a frame period and then counting a predetermined time from the frame signal. In such a regular transmission of sensing data SS, time points to transmit indication signals—time points to transmit sensing data, for another example—respectively assigned the data driving integrated circuits 220 may be different from each other. Each of the data driving integrated circuits 220 may determine a time point to transmit sensing data SS different from the others by counting a different time from the frame period.

The transmitting circuit 420 of the data driving integrated circuit 220 may irregularly re-transmit sensing data as necessary. For example, in a case when the transmitting circuit 420 of the data driving integrated circuit 220 fails to transmit sensing data SS in a certain period, it may re-transmit the sensing data SS at a certain time point. For another example, in a case when the data processing integrated circuit 240 requests the re-transmission of sensing data SS, the transmitting circuit 420 of the data driving integrated circuit 220 may re-transmit sensing data SS at a certain time point.

The transmitting circuit 420 of the data driving integrated circuit 220 may transmit sensing data SS in a time section where an indication signal IC is transmitted. Here, the transmitting circuit 420 may transmit sensing data SS after a first time period has passed from the time point when the indication signal IC began being transmitted.

Figure 5:
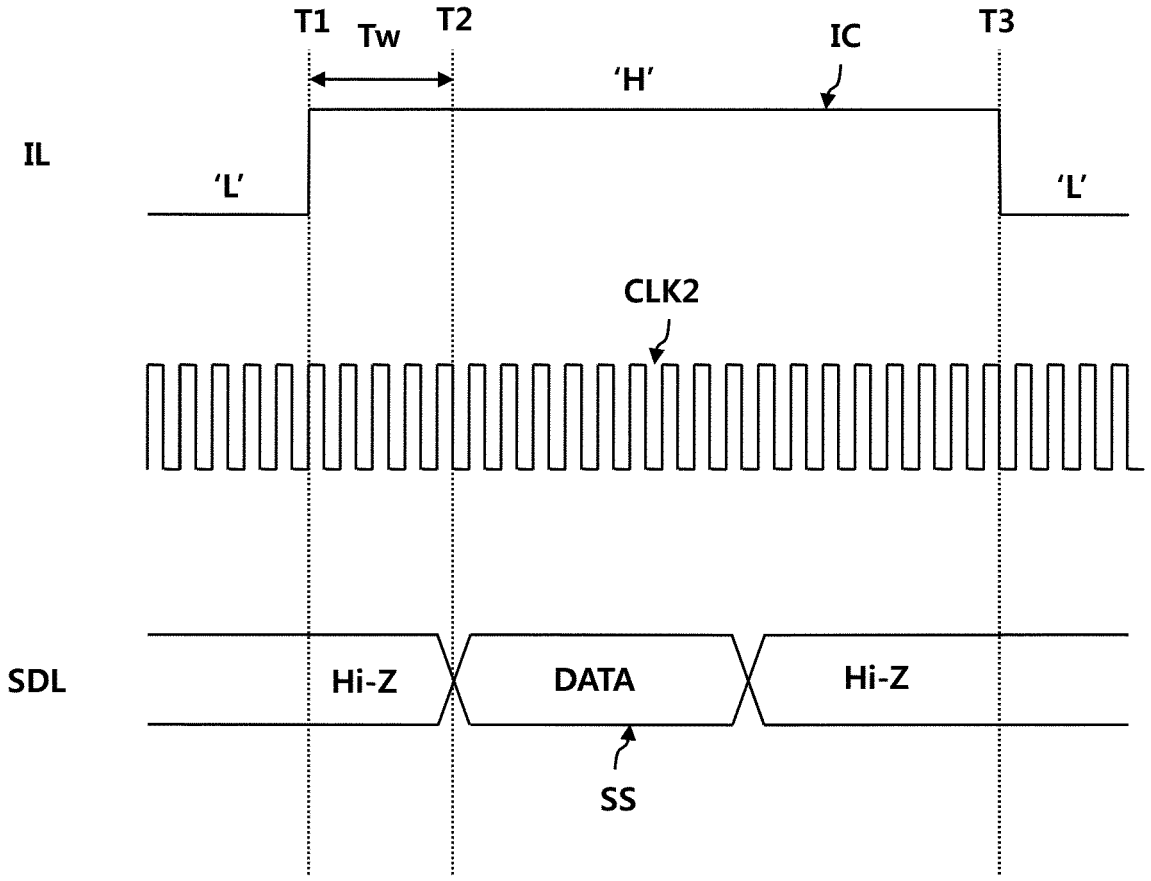
FIG. 5 is a timing diagram illustrating time points for transmitting an indication signal and sensing data according to an embodiment.

FIG. 5 is a timing diagram illustrating time points for transmitting an indication signal and sensing data according to an embodiment.

Referring to FIG. 5, the signal controlling circuit of the data driving integrated circuit may transmit an indication signal IC to the data processing integrated circuit by changing a level of a voltage formed in the signal line IL from logic low L to logic high H. In such an example, a time section where the level of the voltage formed in the signal line IL is logic high H may be considered as a time section where an indication signal IC is transmitted.

The transmitting circuit of the data driving integrated circuit may transmit sensing data SS in a time section T1-T3 where an indication signal IC is transmitted. The transmitting circuit of the data driving integrated circuit may transmit sensing data SS at a certain time point after a first time period Tw has passed from a time point T1 when an indication signal IC began being transmitted or at a time point T2 when the first time period Tw has just finished.

The first time period Tw may be referred to as a stand-by time. The transmitting circuit of the data driving integrated circuit may stand by without transmitting sensing data SS during the first time period Tw after transmitting an indication signal IC. This first time period Tw is to prevent the transmissions of sensing data SS from a collision occurring due to the different data driving integrated circuits transmitting indication signals simultaneously or at close time points.

When receiving indication signals through the two signal lines IL, the signal controlling circuit of the data processing integrated circuit may block one of the indication signals which was transmitted later. The transmitting circuit of the data driving integrated circuit, which stands by for a first time period Tw from a time point of transmitting an indication signal IC, may not transmit sensing data SS when the indication signal IC is blocked by the signal controlling circuit of the data processing integrated circuit. When an indication signal IC is not blocked by the signal controlling circuit of the data processing integrated circuit until the first time period Tw has passed and the transmission of the indication signal IC is maintained until the end of the lapse of the first time period Tw, the transmitting circuit of the data driving integrated circuit may transmit sensing data SS.

The data driving integrated circuit may include a second clock CLK2 therein and count rising edges or falling edges of the second clock CLK2 to check the lapse of the first time period Tw. For example, the data driving integrated circuit may recognize the lapse of the first time period Tw by counting the falling edges of the second clock CLK2 from a time point T1 where an indication signal IC is transmitted and checking if a count value is K (K is an integer, which is 2 or higher).

The second clock CLK2 may be the same as the first clock (see CLK1 in FIG. 4) or a clock derived from the first clock. The first clock or the second clock CLK2 may be transmitted or received in the Transistor-Transistor Logic (TTL) method or the mini Low Voltage Differential Signaling (mLVDS) method. When the second clock CLK2 is received from outside like the first clock is, the data driving integrated circuit and the data processing integrated circuit may measure time on the basis of the same clock and the plurality of the data driving integrated circuits may be synchronized with the same clock.

The transmitting circuit of the data driving integrated circuit may output a Hi-Z state (high impedance state) to the sensing data line SDL in a time section where sensing data is not transmitted. For example, the transmitting circuit of the data driving integrated circuit may make the impedance measured in the sensing data line SDL be a high impedance. For another example, the transmitting circuit of the data driving integrated circuit may be disconnected from the sensing data line SDL to become a floating state.

Figure 6:
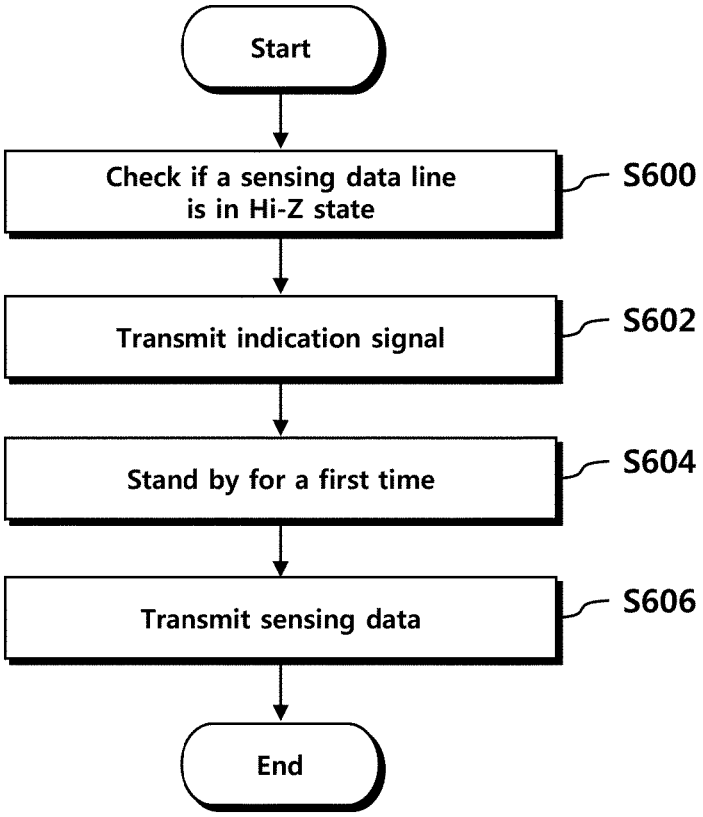
FIG. 6 is a flow diagram illustrating a process of transmitting sensing data in a data driving integrated circuit according to an embodiment.

FIG. 6 is a flow diagram illustrating a process of transmitting sensing data in a data driving integrated circuit according to an embodiment.

Referring to FIG. 6, the transmitting circuit of the data driving integrated circuit may check, before transmitting sensing data, if the sensing data line is in the Hi-Z state (S600). When one of the data driving integrated circuits transmits sensing data, the sensing data line is not in the Hi-Z state. Accordingly, the transmitting circuit of the data driving integrated circuit checks the state of the sensing data line and may transmit or prepare to transmit sensing data when the sensing data line is determined to be in the Hi-Z state.

When the sensing data line is determined to be in the Hi-Z state, the transmitting circuit of the data driving integrated circuit may transmit an indication signal through the signal line (S602) and stand by for the first time period (S604).

In a case when the transmission of the indication signal is not blocked until the first time period has passed and maintained until the end of the lapse of the first time period Tw, the transmitting circuit of the data driving integrated circuit may transmit sensing data SS (S606).

Figure 7:
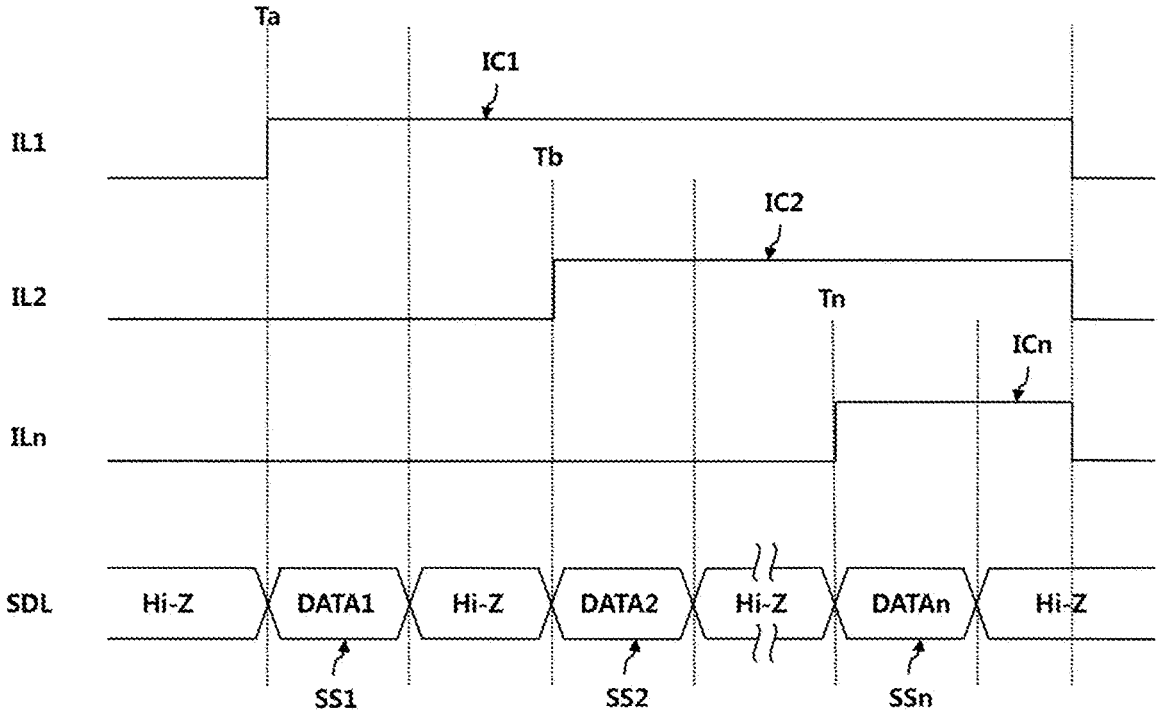
FIG. 7 is a timing diagram illustrating signals formed in signal lines and a sensing data line according to an embodiment.

FIG. 7 is a timing diagram illustrating signals formed in signal lines and a sensing data line according to an embodiment.

Among the plurality of the data driving integrated circuits sharing the sensing data line SDL, a first data driving integrated circuit may transmit a first indication signal IC1 through a first signal line IL1 at a first time point Ta and subsequently transmit a first sensing data SS1 through the sensing data line SDL. When the transmission of the first sensing data SS1 is finished, the first data driving integrated circuit may make the sensing data line SDL to be in the Hi-Z state.

A second data driving integrated circuit may determine that the sensing data line SDL is in the HI-Z state, transmit a second indication signal IC2 through a second signal line IL2 at a second time point Tb, and subsequently transmit a second sensing data SS2 through the sensing data line SDL. When the transmission of the second sensing data SS2 is finished, the second data driving integrated circuit may make the sensing data line SDL be in the Hi-Z state.

In a method described above, each data driving integrated circuit may sequentially transmit sensing data. A Nth data driving integrated circuit, which is the last in the sequence, may check if the sensing data line SDL is in the Hi-Z state, transmit an Nth indication signal ICn through an Nth signal line ILn at a Nth time point Tn, and subsequently transmit a Nth sensing data SSn through the sensing data line SDL. When the transmission of the Nth sensing data SSn is finished, the Nth data driving integrated circuit may make the sensing data line SDL to be in the Hi-Z state.

Figure 8:
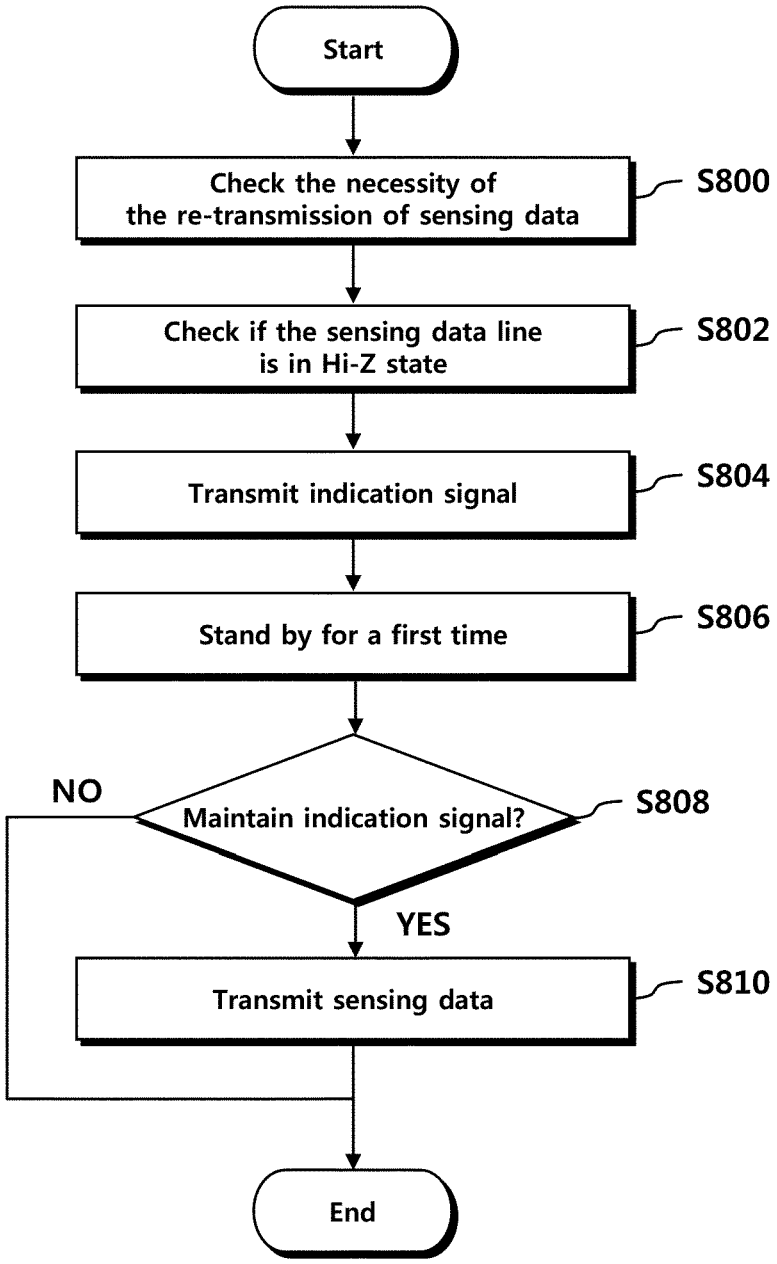
FIG. 8 is a flow diagram illustrating a process of retransmitting sensing data in a data driving integrated circuit according to an embodiment.

FIG. 8 is a flow diagram illustrating a process of re-transmitting sensing data in a data driving integrated circuit according to an embodiment.

Referring to FIG. 8, the data driving integrated circuit may check if the sensing data needs to be re-transmitted (S800).

In a case when the re-transmission of the sensing data is required, the data driving integrated circuit may check if the sensing data line is in the Hi-Z state (S802).

When the sensing data line is determined to be in the Hi-Z state, the data driving integrated circuit may transmit an indication signal through the signal line (S804) and stand by for a first time period (S806).

In a case when a plurality of data driving integrated circuits irregularly transmit sensing data, the transmission of sensing data of one data driving integrated circuit may collide with the transmission of sensing data of another's. Such a collision may be prevented by the control of the data processing integrated circuit.

When receiving indication signals through the two signal lines, the signal controlling circuit of the data processing integrated circuit may block the later transmitted indication signal. In a case when an indication signal is transmitted in a way that changes the voltage level of the signal line to be logic high H, the signal controlling circuit of the data processing integrated circuit may block the indication signal by changing the voltage level of the signal line to be logic low L.

While standing by for a first time period, the data driving integrated circuit may check if the indication signal is not maintained for the above-described reason (S808).

In a case when the indication signal is not maintained for the first time period (NO in S808), the data driving integrated circuit may end the procedure without transmitting sensing data.

In a case when the indication signal is maintained for the first time period (YES in S808), the data driving integrated circuit may transmit sensing data to the data processing integrated circuit.

On the other hand, an indication signal may also be transmitted from the data processing integrated circuit to the data driving integrated circuit.

Figure 9:
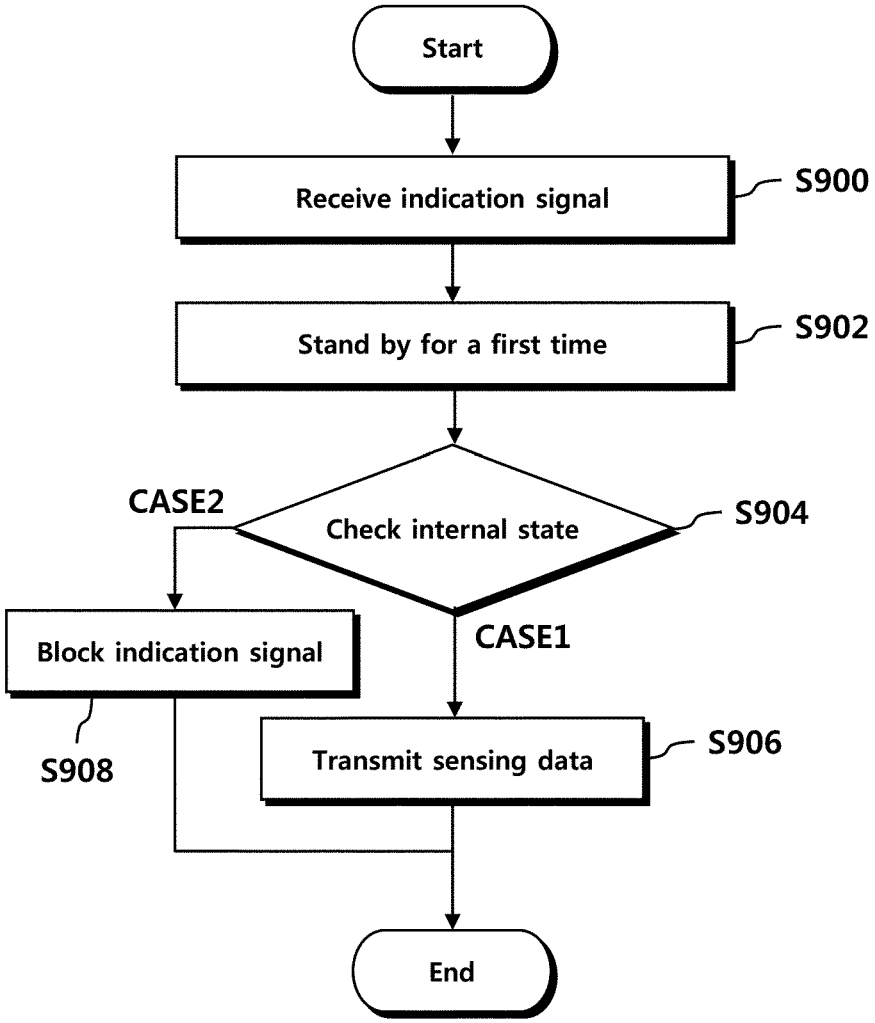
FIG. 9 is a flow diagram illustrating a process of receiving an indication signal and transmitting sensing data in a data driving integrated circuit according to embodiment.

FIG. 9 is a flow diagram illustrating a process of receiving an indication signal and transmitting sensing data in a data driving integrated circuit according to an embodiment.

Referring to FIG. 9, the signal controlling circuit of the data processing integrated circuit may also transmit an indication signal to the data driving integrated circuit. The signal controlling circuit of the data driving integrated circuit may receive such an indication signal (S900).

Subsequently, the data driving integrated circuit may stand by for a first time period (S902).

While standing by for the first time period, the data driving integrated circuit may check its internal state (S904).

In a case when the internal state is a state in which it is difficult to transmit sensing data, for example, that sensing data is not generated since data is in the middle of conversion or that an error is detected in sensing data (CASE2 in S904), the data driving integrated circuit may block an indication signal (S908). In this case, the data processing integrated circuit may recognize that the data driving integrated circuit is in a state unavailable to transmit sensing data by determining the blockage of the indication signal.

In a case when there is no unavailability in the internal state (CASE1 in S904), the data driving integrated circuit may transmit sensing data to the data processing integrated circuit (S906).

As described above, according to the present disclosure, a plurality of integrated circuits sharing a data line may efficiently transmit data. For example, each of the integrated circuits may regularly or irregularly transmit data, data may easily be re-transmitted to complement data, and only some integrated circuits may repeatedly transmit or re-transmit data. This increases the efficiency of the transmission and the reception of data.

Since terms, such as "including," "comprising," and "having" mean that corresponding elements may exist unless they are specifically described to the contrary, it shall be construed that other elements can be additionally included, rather than that such elements are omitted. All technical, scientific or other terms are used consistently with the meanings as understood by a person skilled in the art unless defined to the contrary. Common terms as found in dictionaries should be interpreted in the context of the related technical writings, rather than overly ideally or impractically, unless the present disclosure expressly defines them so.

Although a preferred embodiment of the present disclosure has been described for illustrative purposes, those skilled in the art will appreciate that various modifications, additions and substitutions are possible, without departing from the scope and spirit of the embodiment as disclosed in the accompanying claims. Therefore, the embodiments disclosed in the present disclosure are intended to illustrate the scope of the technical idea of the present disclosure, and the scope of the present disclosure is not limited by the embodiment. The scope of the present disclosure shall be construed on the basis of the accompanying claims in such a manner that all of the technical ideas included within the scope equivalent to the claims belong to the present disclosure.

What is claimed is:

1. An integrated circuit for sensing one section of a panel, which is divided into a plurality of sections, comprising:

a sensing circuit to sense a characteristic of a pixel disposed in the one section and to generate sensing data;

a signal controlling circuit to transmit an indication signal to a device for gathering the sensing data through a signal line connected in a 1:1 way; and a transmitting circuit to transmit, according to the transmission of the indication signal, the sensing data through a data line connected in a 1:N way (N is a natural number, which is 2 or higher), wherein the transmitting circuit determines a time point to transmit the indication signal by counting a predetermined time from a frame signal indicating a frame period.

2. The integrated circuit of claim 1, wherein the signal line is a single line and the signal controlling circuit transmits the indication signal by changing a level of a voltage formed in the signal line.

3. The integrated circuit of claim 1, wherein the transmitting circuit transmits the sensing data in a time section where the indication signal is transmitted after a first time period has passed from a time point when the indication signal began being transmitted.

4. The integrated circuit of claim 3, wherein the transmitting circuit transmits the sensing data in a case when the transmission of the indication signal is not blocked until the first time period has passed and maintained until an end of a lapse of the first time period.

5. The integrated circuit of claim 1, wherein the transmitting circuit checks a state of the data line and transmits the sensing data when the data line is determined to be in a Hi-Z (high impedance) state.

6. The integrated circuit of claim 1, wherein the transmitting circuit outputs a Hi-Z (high impedance) state to the data line in a time section where the sensing data is not transmitted.

7. The integrated circuit of claim 1, further comprising a clock receiving circuit to receive a clock from the device through a clock line, wherein the transmitting circuit transmits the sensing data synchronized with the clock.

8. The integrated circuit of claim 1, wherein the indication signal indicates that the data line is occupied by the integrated circuit or instructs the integrated circuit to occupy the data line.

9. The integrated circuit of claim 1, further comprising a receiving circuit to receive image data complemented according to the sensing data; and a driving circuit to convert the image data into a data voltage and transmit the data voltage through a data voltage line connected with the pixel.

10. An integrated circuit for sensing one section of a panel, which is divided into a plurality of sections, comprising:

a sensing circuit to sense a characteristic of a pixel disposed in the one section and to generate sensing data;

a signal controlling circuit to transmit an indication signal to a device for gathering the sensing data through a signal line connected in a 1:1 way; and a transmitting circuit to transmit, according to the transmission of the indication signal, the sensing data through a data line connected in a 1:N way (N is a natural number, which is 2 or higher), wherein the transmitting circuit regularly transmits the sensing data every period, however, in a case when the transmission of the sensing data fails in a period, re-transmits the sensing data at a certain time point.

11. A data processing integrated circuit, comprising:

a receiving circuit to receive sensing data of a pixel disposed on a panel from a plurality of data driving integrated circuits through a sensing data line connected in a 1:N way (N is a natural number, which is 2 or higher);

a signal controlling circuit to receive an indication signal through a plurality of signal lines respectively connected in a 1:1 way with the data driving integrated circuits and identifies one of the data driving integrated circuits transmitting the sensing data according to the indication signal;

a complementing circuit to complement image data according to the sensing data; and a transmitting circuit to transmit complemented image data to each of the data driving integrated circuits through each of image data lines, when receiving the indication signals through two of the plurality of signal lines, the signal controlling circuit blocks a later transmitted one of the indication signals.

12. The data processing integrated circuit of claim 11, wherein the signal controlling circuit inversely transmits the indication signal to a first data driving integrated circuit and the complementing circuit complements a previously received sensing data using the sensing data received from the first data driving integrated circuit according to the inversely transmitted indication signal.

13. The data processing integrated circuit of claim 11, wherein the receiving circuit is connected with a plurality of sensing data lines and separately receives the sensing data through each of the plurality of sensing data lines.

14. The data processing integrated circuit of claim 11, further comprising a clock transmitting circuit to transmit a clock to the plurality of data driving integrated circuits through a clock line connected in common with the plurality of data driving integrated circuits, wherein the receiving circuit receives the sensing data synchronized with the clock.

15. The data processing integrated circuit of claim 11, wherein each of the plurality of the data driving integrated circuits receives a frame signal indicating a frame period and determines a time point to transmit the indication signal by counting a predetermined time from the frame signal.

16. The data processing integrated circuit of claim 11, wherein each of the plurality of the data driving integrated circuits checks a state of the data line and transmits the sensing data at a time point determined by the data driving integrated circuit when the data line is not recognized to be in a specific state in which the sensing data cannot be transmitted.

* * * * *